US005540358A

United States Patent [19]

Wiles et al.

[11] Patent Number: 5,540,358

[45] Date of Patent: Jul. 30, 1996

[54] FLEXIBLE PLANAR GUSSETED PACKAGE FOR DISPENSING A PRODUCT THROUGH A FITMENT

[75] Inventors: Jerald R. Wiles, Sarasota, Fla.; Dana P. Gruenbacher, Fairfield, Ohio

[73] Assignee: The Procter and Gamble Company, Cincinnati, Ohio

[21] Appl. No.: 359,155

[22] Filed: Dec. 19, 1994

(Under 37 CFR 1.47)

[51] Int. Cl.[6] ..... B65D 35/08

[52] U.S. Cl. ..... 222/107

[58] Field of Search ..... 222/107, 92; 493/213

[56] References Cited

U.S. PATENT DOCUMENTS

| | | | |
|---|---|---|---|
| 2,947,653 | 8/1960 | Fohr | 154/83 |
| 2,970,723 | 2/1961 | Flax | 222/107 |
| 3,108,732 | 10/1963 | Curie et al. | 229/14 |
| 3,128,913 | 4/1964 | Specketer | 222/107 |
| 3,258,169 | 6/1966 | Paisley | 222/107 |
| 3,338,475 | 8/1967 | Englesson | 222/107 |
| 3,381,874 | 5/1968 | Russo | 229/7 |
| 3,435,990 | 4/1969 | Pike, Jr. | 222/1 |
| 3,690,524 | 9/1972 | Haberhauer | 222/573 |
| 4,090,541 | 5/1978 | Cammarata, III et al. | 150/0.5 |
| 4,394,936 | 7/1983 | Shavit | 222/107 |
| 4,452,378 | 6/1984 | Christine | 222/107 |
| 4,601,410 | 7/1986 | Bond | 222/92 |
| 4,640,425 | 2/1987 | Cabernoch | 215/11 E |
| 4,718,778 | 1/1988 | Ichikawa | 383/100 |
| 4,732,299 | 3/1988 | Hoyt | 222/94 |
| 4,776,488 | 10/1988 | Gurzan | 222/81 |
| 4,830,205 | 5/1989 | Hammond et al. | 215/11.3 |
| 5,018,646 | 5/1991 | Billman et al. | 222/107 |
| 5,135,464 | 8/1992 | Buchanan | 493/203 |
| 5,273,362 | 12/1993 | Buchanan | 383/104 |
| 5,307,955 | 5/1994 | Viegas | 222/107 |
| 5,348,398 | 9/1994 | Buchanan | 383/122 |
| 5,348,525 | 9/1994 | Buchanan | 493/213 |

FOREIGN PATENT DOCUMENTS

| | | |
|---|---|---|
| 610259 | 4/1979 | Switzerland . |

*Primary Examiner*—Gregory L. Huson

*Attorney, Agent, or Firm*—Michael J. D'Amelio; Dean L. Garner

[57] ABSTRACT

In accordance with the present invention there is provided a flexible package for dispensing a product through a fitment. The package has a planar enclosed body extending between a bottom end and a top end. The package further includes a planar gusset panel sealed to the body at the top end. The gusset panel is sealed to the body such that the package can be folded so that the gusset panel will lie flat against and in the same plane as the body of the package. The gusset panel further includes an aperture disposed therein. A dispensing fitment extends through the aperture on the gusset panel for dispensing.

19 Claims, 5 Drawing Sheets

FLEXIBLE PLANAR GUSSETED PACKAGE FOR DISPENSING A PRODUCT THROUGH A FITMENT

FIELD OF THE INVENTION

The present invention relates to packages for storing and dispensing products especially fluid or paste type materials. More particularly, the invention relates to tube-like packages or pouches wherein the product is dispensed through a fitment.

BACKGROUND OF THE INVENTION

For many years consumer products, such as toothpaste, have been stored and dispensed from tubes having dispensing fitments therein. Typically, these tubes are made from plastic laminates and are formed by heat sealing a round fitment within the tube or injection molding a fitment into the tube. In order to give these tubes the necessary rigidity that consumers prefer, or to make stand-up tubes, the plastic laminates are usually relatively thick (0.008 in. to 0.012 in.). Moreover, the tubes are typically manufactured at one site and then filled with product at another site in order to increase manufacturing reliability and to avoid capital equipment cost. Therefore, due to the amount of material used to make these tubes, the cost of the equipment and the manufacturing method used, these tubes are relatively expensive, especially for people residing in developing countries.

Recently, there has been the desire to package products such as toothpaste in flexible pouches which can be made from a broad range of thin plastic laminates or which can otherwise be manufactured less expensively. These materials and manufacturing methods are cheaper than the traditional methods mentioned above. When the amount of material used is reduced the package takes on more of a pouch appearance than that of a semi-rigid tube. Consumers have shown a preference towards pouches which have the appearance of a typical toothpaste tube and have a dispensing fitment conveniently located at the end of the package. Typically, this is done by sealing the fitment in the seal region of the pouch. One example of this is given in U.S. Pat. No. 2,970,723 issued to Flax on Feb. 7, 1961. However, making this type of package results in a complex sealing process which often causes leaks, especially when making it out of thin plastic laminates. Moreover, the size and design of the fitments required for these types of packages are expensive and often require split cavity side action molds to make them.

Other packages have a fitment sealed in the face of the package, such as the one shown in U.S. Pat. No. 4,601,410 issued to Bond on Jul. 22, 1986. While this reduces the chances of having leaks because the fitment is not sealed in the seal area of the pouch, dispensing from the package is not easy to control since the line of sight is hidden by the package. Moreover, packages with fitments sealed in the face lose their tube like appearance which is important to consumers. It is, therefore, desired to have a package where the fitment is at the end of the package but is not sealed in the sealed area of the pouch so that it provides good dispensing with little or no leaks.

One example of a pouch which overcomes the above problems is given in U.S. Pat. No. 5,307,955 issued to Viegas on May 3, 1994 which is hereby incorporated herein by reference. This patent discloses a tubular package having a gusset panel sealed at its bottom and a self-sealing valve extending through the gusset panel. However, this package has two disadvantages for dispensing products such as toothpaste. First, as was said above, consumers have a desire for these packages to look as much like an ordinary toothpaste tube as possible. As seen from the figures of this reference, this package does not look much like an ordinary toothpaste tube. Second, because of the way the tubular body and gusset panel are sealed at the bottom end, it is difficult, especially for paste type products, to get all of the product out of the package.

There has, therefore, been a desire to provide a pouch having a dispensing fitment therein which looks very similar to an ordinary toothpaste tube and which lends itself to substantially complete emptying by the consumer. It is also desired to have such a pouch where the fitment is disposed on the end of the pouch and is not sealed to the pouch along the seal area.

SUMMARY OF THE INVENTION

In accordance with the present invention there is provided a flexible package for dispensing a product through a fitment. The package has a planar enclosed body extending between a bottom end and a top end. The package further includes a planar gusset panel sealed to the body at the top end. The gusset panel is sealed to the body such that the package can be folded so that the gusset panel will lie flat against and in the same plane as the body of the package. The gusset panel further includes an aperture disposed therein. A dispensing fitment extends through the aperture on the gusset panel for dispensing.

In accordance with another aspect of the present invention there is provided a flexible package for dispensing a product through a fitment. The package has a substantially planar enclosed body having an interior for containing the product and an exterior. The body extends between a bottom end and a top end. The package includes a substantially planar gusset panel secured to the top end. The gusset panel has an opposing top and bottom and opposing sides wherein an aperture is disposed between the top, bottom and sides. Each of the sides of the gusset panel is sealed to the body of the package by a substantially V-shaped seal wherein the seal points away from the aperture. The seals are such that the body of the package can be folded so that the gusset panel will lie fiat against and in substantially the same plane as the body. Lastly, the package includes a dispensing fitment extending through the aperture in the gusset panel.

BRIEF DESCRIPTION OF THE DRAWINGS

While the specification concludes with claims particularly pointing out and distinctly claiming the subject invention it is believed that the same will be better understood from the following description when taken in conjunction with the accompanying drawings in which:

FIG. 4 is a plan view of web 50 of which the package shown in the above Figures is made from.

DETAILED DESCRIPTION OF THE INVENTION

Figure 1:
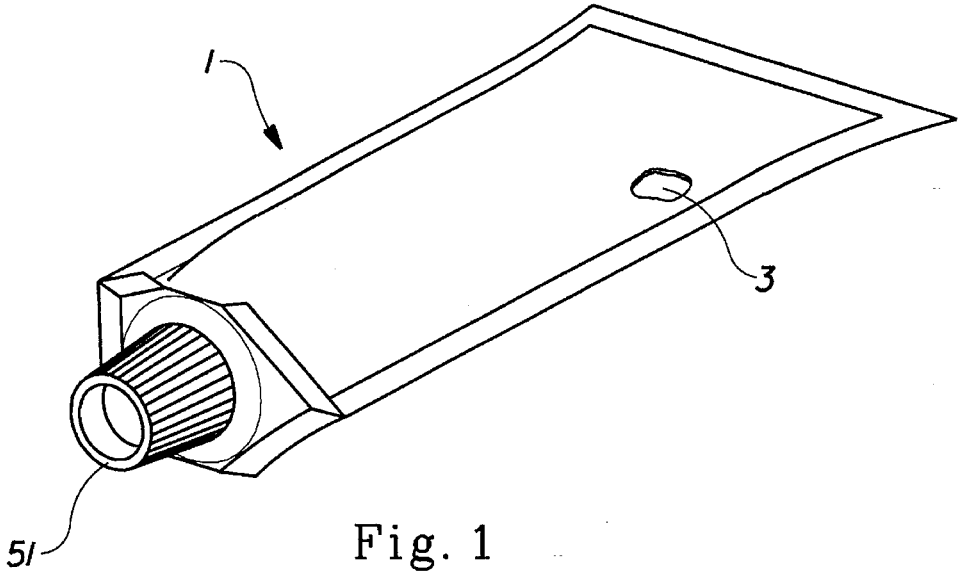
FIG. 1 is a perspective view of the package of the present invention showing the package filled with product and sealed.
Figure 2:
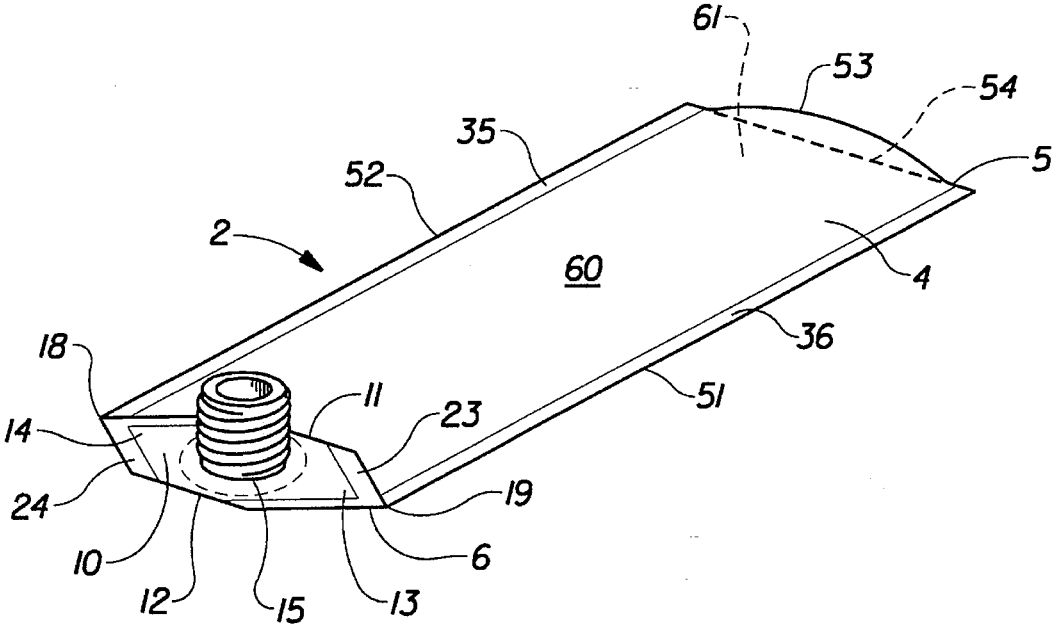
FIG. 2 is a perspective view of the package shown in FIG. 1 but showing the package before it is filled and sealed.

Referring to the drawings in detail wherein like numerals indicate the same element throughout the views there is shown in FIG. 1 a flexible package 1 for dispensing a product such as toothpaste. FIG. 1 shows the package as it appears after being filled with product and sealed. FIG. 2 shows the package 1 before it is filled with product and sealed. As seen from that figure, package 1 has a substantially planar enclosed body 2 having an interior 3 and an exterior 4. The body extends between a bottom end 5 and a top end 6. The package further includes a substantially planar gusset panel 10 sealed to the body at the top end. As is explained below for the embodiment shown in FIGS. 1 and 2 gusset panel 10 is what is referred to as a W-gusset or T-gusset panel which is integral with the body 2. However, the gusset panel could be a separate piece sealed to the body.

Figure 3:
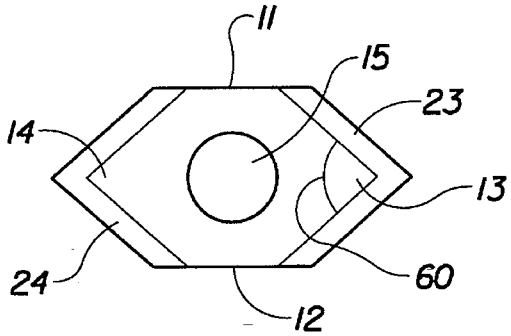
FIG. 3 is a plan view of the gusset panel 10 of the package of the present invention.

The gusset panel 10, as best seen from FIG. 3, has an opposing top and bottom 11 and 12 and opposing sides 13 and 14. An aperture 15 is disposed between the top, bottom and sides. In a preferred embodiment, each of the sides 13 and 14 of gusset panel 10 is sealed to the body 2 of the package 1 by a substantially V-shaped seal, 23 and 24, wherein the V points away from the aperture 15. This V-shaped seal provides for the tapered tube shape at the top which consumers are accustomed to and acts and looks like the shoulder of a conventional toothpaste tube. Furthermore, the V-shape seals increase the structural strength/rigidity to reduce the flexing of the package near the gusset panel when the cap 51 is removed.

As seen from FIG. 2, seals 23 and 24 are such that the body of the package can be folded along points adjacent to the top 6 along a line running from side 13 to side 14 so that the gusset panel 10 will lie flat against and in substantially the same plane as the body 2 of package 1. This feature is important because a gusset panel which behaves in this manner lends itself to more complete emptying of the package. Typically the product is dispensed by squeezing the body 2 so that the product is dispensed through the fitment 30. As the package nears the end of its life most of the product is concentrated near the bottom. A gusset panel which can lie flat, as mentioned above, makes it easier to more completely empty the package. Because the gusset panel is flat before the package is filled with product, it can return to its flat condition when the package nears its end so that substantially all of the product can be expelled.

The package includes a dispensing fitment 30 extending through the aperture in the gusset panel for dispensing the product. Fitment 30 can be of any type well known in the art such as flip tops or the like. The one shown in the figures is an externally threaded round plastic fitment sealed to the gusset panel and which cooperates with an internally threaded closure 51 (shown in FIG. 1).

Figure 4:
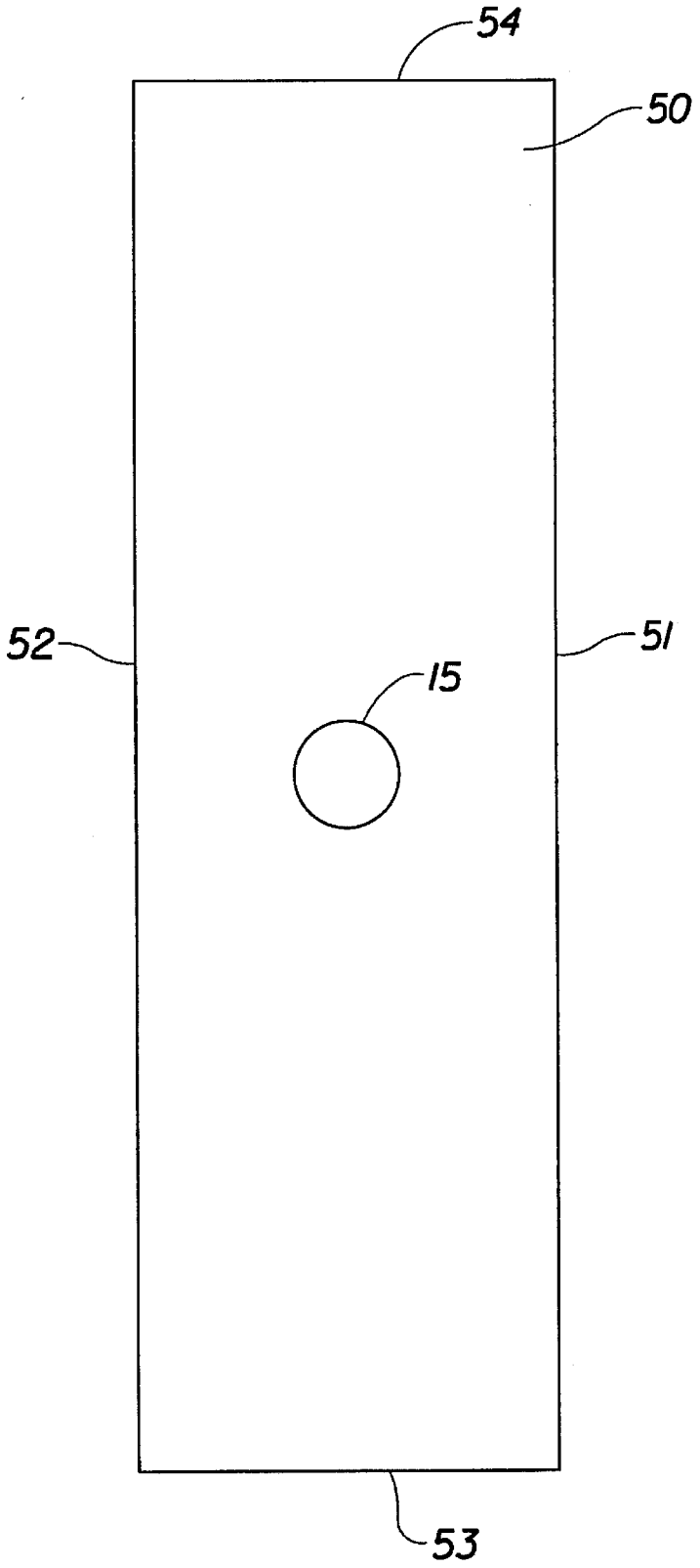

It is preferable that gusset panel 10 and the body 2 are integral with one another. That is, gusset panel 10 and body 2 are made from a single substantially rectangular web of flexible material 50, as shown in FIG. 4. Web 50 can be made from any number of materials known in the art. Preferably materials that run well on form/fill/seal equipment. These films preferably have a laminate structure where the outside layer has a significantly higher melting point than the inside sealant layer. This allows the W-gusset to be heat sealed without the exterior layers becoming heat sealed together in the forming process. This also provides for faster line speeds at higher temperatures. Some examples of preferred films are 25 to 75 microns of Low Density Polyethylene or Medium Density Polyethylene as the inner sealant layer followed by a suitable barrier layer, if needed, and 9 to 20 microns or Polyethylene Terapthalate or Oriented Polypropylene for the heat resistant exterior layer required for fast high temperature seals. The preferred total thickness of web 50 ranges from about 100 to 254 microns total thickness depending on the size and desired feel of the package.

Figure 5A:
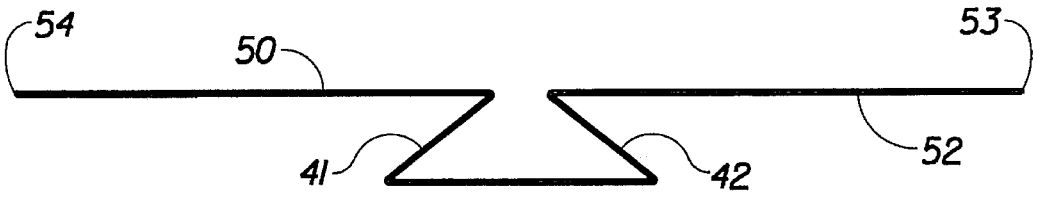
FIGS. 5A–5C are side views of the web of FIG. 4 showing different stages of the formation of the package.
Figure 5B:
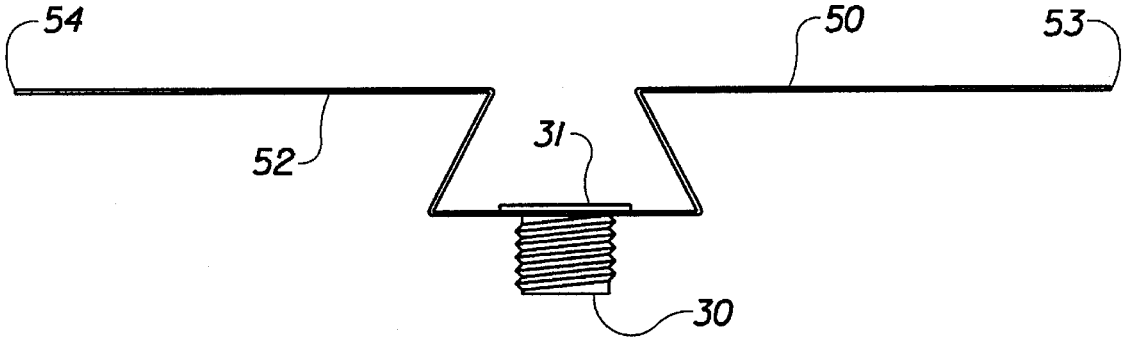
Figure 5C:
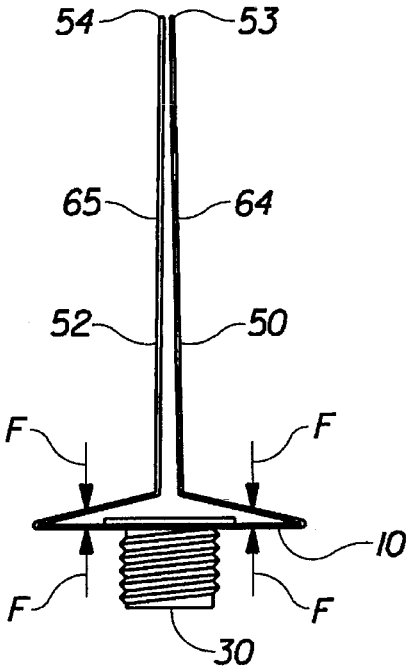

As was stated earlier, web 50 will be folded and sealed such that it will form body 2 and gusset panel 10. Web 50 has opposing major peripheral edges 51 and 52 and opposing minor peripheral edges 53 and 54. Aperture 15 is between the major and minor peripheral edges. The gusset panel is made by folding the web 50 in the same direction on each side of the aperture along a line substantially parallel to the minor peripheral edges. This is commonly referred to ion the art as a W-gusset. These two folds, 41 and 42, are shown in FIG. 5A. After the folds 41 and 42 are made, minor peripheral edges are pulled away somewhat to allow fitment 15 to be placed therein, as shown in FIG. 5B, so that the web is folded towards the seal region 31 of the fitment 30. Thereafter the folds are brought back to their original position and are compressed in the direction of arrows F and sealed as shown in FIG. 5C, thereby creating gusset panel 10. Preferably, the fitment is sealed in the flat web first and the W-gusset is formed as shown in FIG. 5C by using any type of suitable equipment known in the art including forming boards or shoulders. However, for thicker films it is helpful to make the folds first and then insert the fitment.

Figure 6:
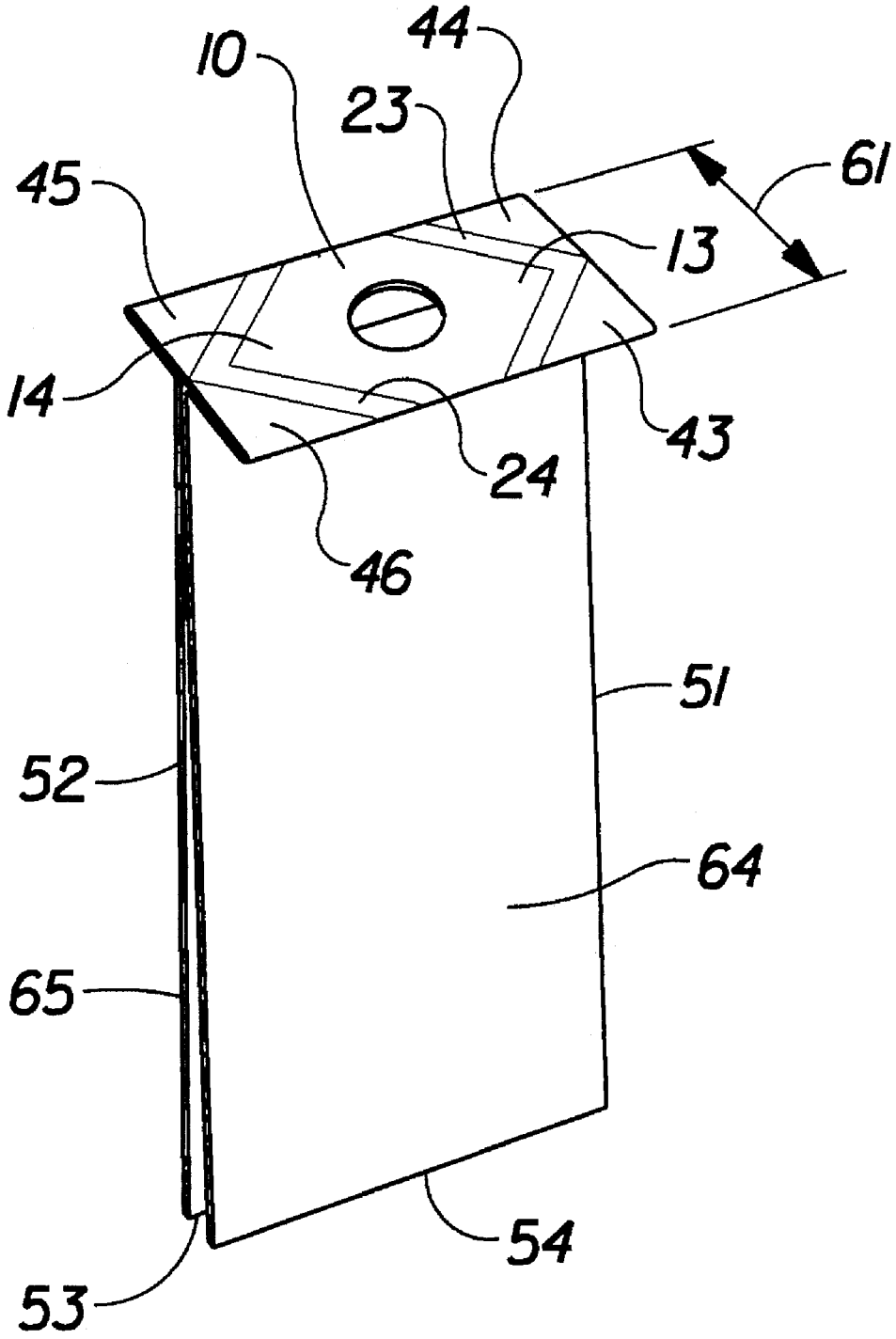
FIG. 6 is a plan view of the package of the present invention showing the package as it appears in FIG. 5C and after the V-shaped seals are formed.

As seen from FIG. 6, after the W-gusset is made, folds 41 and 42 are compressed and sealed together in areas adjacent to the sides 13 and 14 of the gusset panel 10 so as to form the substantially V-shaped seals 23 and 24. This is best shown by referring to FIG. 6. The seals can be created by any number of methods known in the art including hot bar heat sealing, impulse sealing, ultrasonic or hot wire. This leaves ears 43–46 extending from the gusset panel 10. It is preferred that the ears be trimmed off, as shown in FIGS. 1–3, so that the package has a more tube like appearance.

Either before, after or while the folds 41 and 42 are sealed and the gusset panel is formed, the minor peripheral edges 53 and 54 are brought together to be adjacent one another as seen in FIG. 5C. This creates a front 64 and back 65 of the package which juxtapose each other as shown in FIGS. 2, 5C and 6. As seen from FIG. 2, the web is sealed along its major peripheral edges 51 and 52 to form the enclosed planar body. Preferably sealing of the major peripheral edges is done by hot bar, ultrasonic, impulse seal, hot wire or the like and the corners 18 and 19 of the gusset are again sealed when the major peripheral edges are sealed to better ensure the integrity of the package especially in the gusset region where the overall package thickness goes from four layers to two layers. Furthermore, it is desired to seal the major peripheral edges so as to eliminate the seal lines, 35 and 36 shown in FIG. 2, and give the package a more smooth appearance. This can be accomplished with hot wire seals creating a line seal. The line seal minimizes the seal width of the fin seals and provides a more tube like appearance and feel to the package. Preferably, there will be no sharp corners on the package which can be accomplished by rounding the edges of the package using cutting dies with the desired rounded shape. Another preferred approach is to make standard fin seals (0.125 in to 0.375 in. wide) and then round the edge of the fin seals heat (flame, hot wire or some other source) or mechanical abrasion. After sealing, the package than then be filled with product from the bottom 3 and the minor peripheral edges 53 and 54 can be sealed so that the package appears as it does in FIG. 1.

The gusset panel can be a separate piece which is sealed to the tubular body. The package could also be made similar to the package disclosed in the herein before incorporated U.S. Pat. No. 5,307,955. However the stand up base of that package would have to be cut away so as to allow the body of the package can be folded, as described above that the gusset panel can lie flat against and in substantially the same plane as the body 2 of package 1.

As seen FIG. 1 it is preferred that after the package is filled with product the gusset panel expands outwardly to give the package a more tube like appearance and for better dispensing. The distance that the gusset expands outwardly is governed by the width 61 (shown in FIG. 6) of the gusset panel. Increasing the gusset width will provide more film for the gusset to expand outwardly when the package is filled. The angle 60 (shown in FIG. 3) of the V-shape seals is ideally the minimum angle to allow the V-seal to go out to top 11 and bottom 12 without interfering with the fitment. Keeping the angle to a minimum will provide more torsion strength to the gusset panel when the consumer screws on or off the cap. Moreover, by minimizing the angle 60 the gusset tapers more, thereby giving the package a more tube like appearance and making complete emptying of the package easier.

Figure 7:
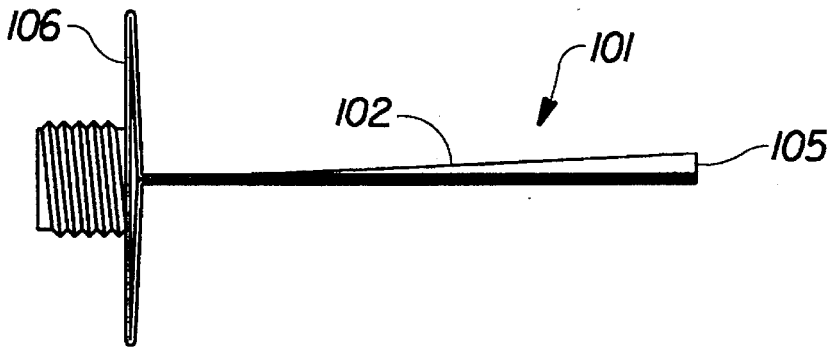
FIG. 7 is a side view of an alternative embodiment of the present invention.
Figure 8:
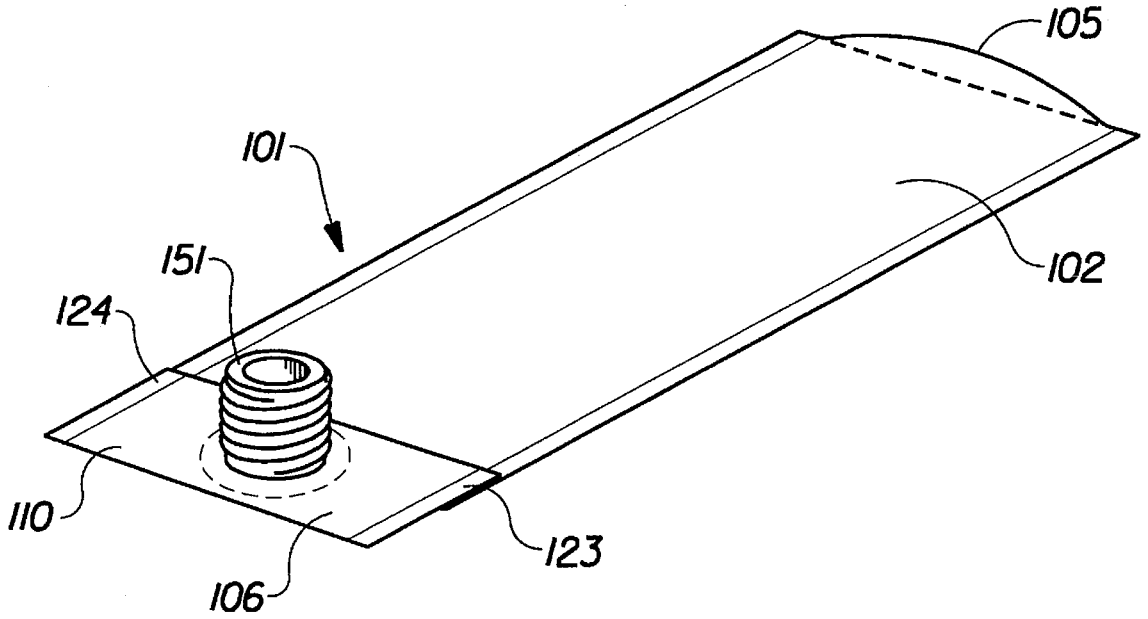
FIG. 8 is a perspective view of the package shown in FIG. 7 showing the gusset panel folded onto the body.

However, the angle could be 180 degrees, thereby going from a V-shaped seal to a straight seal extending along the sides 13 and 14 of the gusset panel. An example of this embodiment is shown in FIGS. 7 and 8 where there is shown a package 101 which is similar to package 1. Package 101 has a planar enclosed body 102 extending between a bottom end 105 and a top end 106. Package 101 has a planar gusset panel 110 sealed to the body at the top end 106. As shown in FIG. 8, gusset panel 110 is sealed to the body such that the package can be folded so that the gusset panel will lie flat against and in the same plane as the body of the package. The gusset panel further includes an aperture 115 disposed therein. A dispensing fitment 151 extends through the aperture on the gusset panel for dispensing.

The difference between packages 1 and 101 is that while gusset panel 110 is still created by a W-gusset and formed very much the same way as described above, package 101 has straight seals 123 and 124 along the sides of the gusset panels instead of V-shape seals 23 and 24.

While particular embodiments of the present invention have been illustrated and described the various modifications would be apparent to those skilled in the art without departing from the spirit and scope of the present invention. Accordingly, the scope of the present invention should be considered in terms of the following claims and is understood not to be limited to the details described and shown in the specification and drawings.

What is claimed is:

1. A flexible package for dispensing a product through a fitment, said package comprising:

(a) a substantially planar enclosed body, said body extending between a bottom end and a top end, and said body having opposing body sides;

(b) a substantially planar gusset panel sealed to said body at said top end, said gusset panel having an aperture disposed therein, said gusset panel having opposing sides that are sealed to said body of said package by gusset seals located generally between said aperture and said body sides, said seals being such that said package can be folded when empty so that said gusset panel will lie flat against and in substantially the same plane as said body; and (c) a dispensing fitment extending through said aperture on said gusset panel.

2. The package according to claim 1 wherein said gusset panel is integral with said body.

3. The package according to claim 1 wherein said dispensing fitment comprises a round externally threaded member.

4. The package according to claim 1 wherein said body and said gusset panel are made from a plastic laminate having a thickness ranging from about 100 microns to about 254 microns.

5. The package according to claim 1 wherein said package is filled with a paste product and said top and bottom of said package are closed.

6. A flexible package for dispensing a product through a fitment, said package comprising:

(a) a substantially planar enclosed body having an interior for containing a product and an exterior, said body extending between a bottom end and a top end;

(b) a substantially planar gusset panel attached to said top end, said gusset panel having an opposing top and bottom, opposing sides and an aperture disposed between said top bottom and sides, each of said sides of said gusset panel being sealed to said body of said package by a substantially V-shape seal pointing away from said aperture, said seals being such that said body of said package can be folded so that said gusset panel will lie flat against and in substantially the same plane as said body; and (c) a dispensing fitment extending through said aperture in said gusset panel.

7. The package according to claim 6 wherein said gusset panel is integral with said body.

8. The package according to claim 7 wherein said gusset panel and said body comprise a substantially rectangular web of flexible material having opposing major peripheral edges and opposing minor peripheral edges, said aperture being between said major and minor peripheral edges, said web being folded so as to create a front and a back of said package which juxtapose each other, said minor peripheral edges being adjacent to each other forming said bottom and said web being sealed along said major peripheral edges thereby forming said enclosed body, said gusset panel comprising two folds one adjacent each of said front and said back of said package, said folds being compressed and sealed in areas adjacent to said sides of said gusset panel so as to form said substantially V-shaped seals on said sides of said gusset panel.

9. The package according to claim 6 wherein said dispensing fitment comprises a round externally threaded member.

10. The package according to claim 6 wherein said dispensing fitment comprises a round member having a flip top cap attached thereto.

11. The package according to claim 6 wherein said body and said gusset panel are made from a plastic laminate having a thickness ranging from about 100 microns to about 254 microns.

12. The package according to claim 6 wherein said gusset panel can expand outwardly when said package is filled with product and sealed.

13. The package according to claim 6 wherein said package is filled with a paste/cream product and said top and bottom of said package are closed.

14. A flexible package for dispensing a product through a fitment, said package comprising:

(a) a substantially planar enclosed body having an interior for containing a product and an exterior, said body extending between a bottom end and a top end;

(b) a substantially planar gusset panel secured to said top end, said gusset panel having an opposing top and bottom, opposing sides and an aperture disposed between said top bottom and sides, each of said sides of said gusset panel being sealed to said body of said package by a substantially V-shape seal pointing away from said aperture, said seals being such that said body of said package can be folded so that said gusset panel will lie flat against and in substantially the same plane as said body said gusset panel being integral with said body;

(c) said gusset panel and said body comprise a substantially rectangular web of flexible material having opposing major peripheral edges and opposing minor peripheral edges, said aperture being between said major and minor peripheral edges, said web being folded so as to create a front and a back of said package which juxtapose each other, said minor peripheral edges being adjacent to each other forming said bottom and said web being sealed along said major peripheral edges thereby forming said enclosed body, said gusset panel comprising two folds one adjacent each of said front and said back of said package, said folds being compressed and sealed in areas adjacent to said sides of said gusset panel so as to form said substantially V-shaped seals on said sides of said gusset panel; and (c) a dispensing fitment extending through said aperture in said gusset panel.

15. The package according to claim 14 wherein said dispensing fitment comprises a round externally threaded member.

16. The package according to claim 14 wherein said dispensing fitment comprises a round member having a flip top cap attached thereto.

17. The package according to claim 14 wherein said body and said gusset panel are made from a plastic laminate having a thickness ranging from about 100 microns to about 254 microns.

18. The package according to claim 14 wherein said gusset panel can expand outwardly when said package is filled with product and sealed.

19. The package according to claim 14 wherein said package is filled with a paste/cream product and said top and bottom of said package are closed.

* * * * *